United States Patent [19]

Maier et al.

[11] 4,219,713

[45] Aug. 26, 1980

[54] CIRCUIT BREAKER WITH HIGH SPEED TRIP LATCH

[75] Inventors: Alfred E. Maier; Louis N. Ricci, both of Beaver Falls, Pa.

[73] Assignee: Westinghouse Electric Corp., Pittsburgh, Pa.

[21] Appl. No.: 755,766

[22] Filed: Dec. 30, 1976

[51] Int. Cl.[2] ..... H01H 3/46

[52] U.S. Cl. ..... 200/153 G; 200/153 SC; 200/322

[58] Field of Search ..... 200/153 G, 153 R, 321, 200/322, 153 SC; 335/15, 76, 46, 47; 74/97, 527, 532

[56] References Cited

U.S. PATENT DOCUMENTS

| | | | |
|---|---|---|---|
| 1,431,288 | 10/1922 | Corder | 220/333 |
| 3,604,875 | 9/1971 | Walters | 200/153 G |
| 4,064,595 | 12/1977 | Learer | 16/128 R |

FOREIGN PATENT DOCUMENTS

| | | | |
|---|---|---|---|
| 1423160 | 1/1965 | France | 200/153 G |
| 933603 | 8/1963 | United Kingdom | 200/153 G |

*Primary Examiner*—Stephen Marcus
*Attorney, Agent, or Firm*—M. S. Yatsko

[57] ABSTRACT

A circuit breaker having stationary and movable contacts operable between open and closed positions with the movable contact being biased in an open position. An operating mechanism, for effecting movement of the contacts between the open and closed positions includes a toggle having first and second links and a toggle lever. Also included is a releasable toggle latch for holding the toggle in a toggle position. The toggle latch includes a rod having a flat surface which is adjacent to and contacts, the toggle lever. The rod is rotatable between first and second positions with the rod flat surface, when in the first position, preventing movement of the toggle lever and when in the second position permits movement of the toggle lever such that the toggle can be released from toggle position. A latch catch is fixedly secured to, and rotatable with, the rod, with movement of a latch catch causing movement of the rod. The latch catch is biased in the rod second position where the toggle lever can be released, and a releasable lever system holds for the latch catch in the rod first position.

5 Claims, 16 Drawing Figures

CIRCUIT BREAKER WITH HIGH SPEED TRIP LATCH

CROSS-REFERENCE TO RELATED APPLICATIONS

Reference is made to the below listed copending applications which are assigned to the same assignee as the present invention.

1. "Circuit Breaker Having Insulation Barrier" by A. E. Maier et al, Ser. No. 755,765, filed Dec. 30, 1976.
2. "Circuit Breaker Having Improved Movable Contact" by H. Nelson et al, Ser. No. 755,767, filed Dec. 30, 1976.
3. "Circuit Breaker Utilizing Improved Current Carrying Conductor System" by H. A. Nelson et al, Ser. No. 755,769, filed Dec. 30, 1976.
4. "Circuit Breaker With Current Carrying Conductor System Utilizing Eddy Current Repulsion" by J. A. Wafer et al, Ser. No. 755,776, filed Dec. 30, 1976.
5. "Circuit Breaker With Dual Drive Means Capability" by W. V. Bratkowski et al, Ser. No. 755,764, filed Dec. 30, 1976.
6. "Stored Energy Circuit Breaker" by A. E. Maier et al., Ser. No. 755,768, filed Dec. 30, 1976, now U.S. Pat.

BACKGROUND OF THE INVENTION

This invention relates generally to single or multi-pole circuit breakers, and more particularly to circuit breakers having a high speed trip latch.

The basic functions of circuit breakers are to provide electrical system protection and coordination whenever abnormalities occur on any part of the system. The operating voltage, continuous current, frequency, short circuit interrupting capability, and time-current coordination needed are some of the factors which must be considered when designing a breaker. Government and industry are placing increasing demands upon the electrical industry for interrupters with improved performance in a smaller package and with numerous new and novel features.

Stored energy mechanisms for use in circuit breakers of the single pole or multi-pole type have been known in the art. A particular construction of such mechanisms is primarily dependent upon the parameters such as rating of the breaker. Needless to say, many stored energy circuit breakers having closing springs cannot be charged while the circuit breaker is in operation. For that reason, some circuit breakers have the disadvantage of not always being ready to close in a moment's notice. These circuit breakers do not have, for example, an open-close-open feature which users of the equipment find desirable.

Another problem present in some prior art circuit breakers is that associated with matching the spring torque curve to the breaker loading. These prior art breakers utilize charging and discharging strokes which are each 180°. The resulting spring torque curve is predetermined, and usually cannot be matched with the breaker loading. Such a predetermined curve mandates that the elements associated with the breaker be matched for this peak torque rather than be matched with the breaker load curve.

An additional feature which is highly desirable in circuit breakers is a high speed trip latch. This is desirable so that, for example, upon the occurrence of a fault condition, the circuit breaker will interrupt current as quickly as possible to minimize any damage which may occur within the electrical system.

SUMMARY OF THE INVENTION

In accordance with this invention, it has been found that a more desirable circuit breaker is provided which comprises stationary and movable contacts operable between open and closed positions, with the movable contact being biased in the open position. Means are included for effecting movement of the contacts between the open and closed positions, and include toggle means having first and second links and a toggle lever. Toggle latch means for holding the toggle means in the toggle position cooperate with the movement effecting means, and comprise a rod having a flat surface thereon which is adjacent to, and contacts the toggle lever. The rod is rotatable between first and second positions with the rod flat surface, when in the first position preventing movement of the toggle lever and, when in the second position, permits movement of the toggle lever such that the toggle means are capable of being released from toggle position. Additionally, a latch catch is fixedly secured to, and rotatable with, the rod. Movement of the latch catch causes movement of the rod secured thereto, and the latch catch is biased in the rod second position. Also included are releasable means for holding the latch catch in the rod first position.

BRIEF DESCRIPTION OF THE DRAWINGS

Reference is now made to the description of the preferred embodiment, illustrated in the accompanying drawings, in which.

DESCRIPTION OF THE PREFERRED EMBODIMENTS

Figure 1:
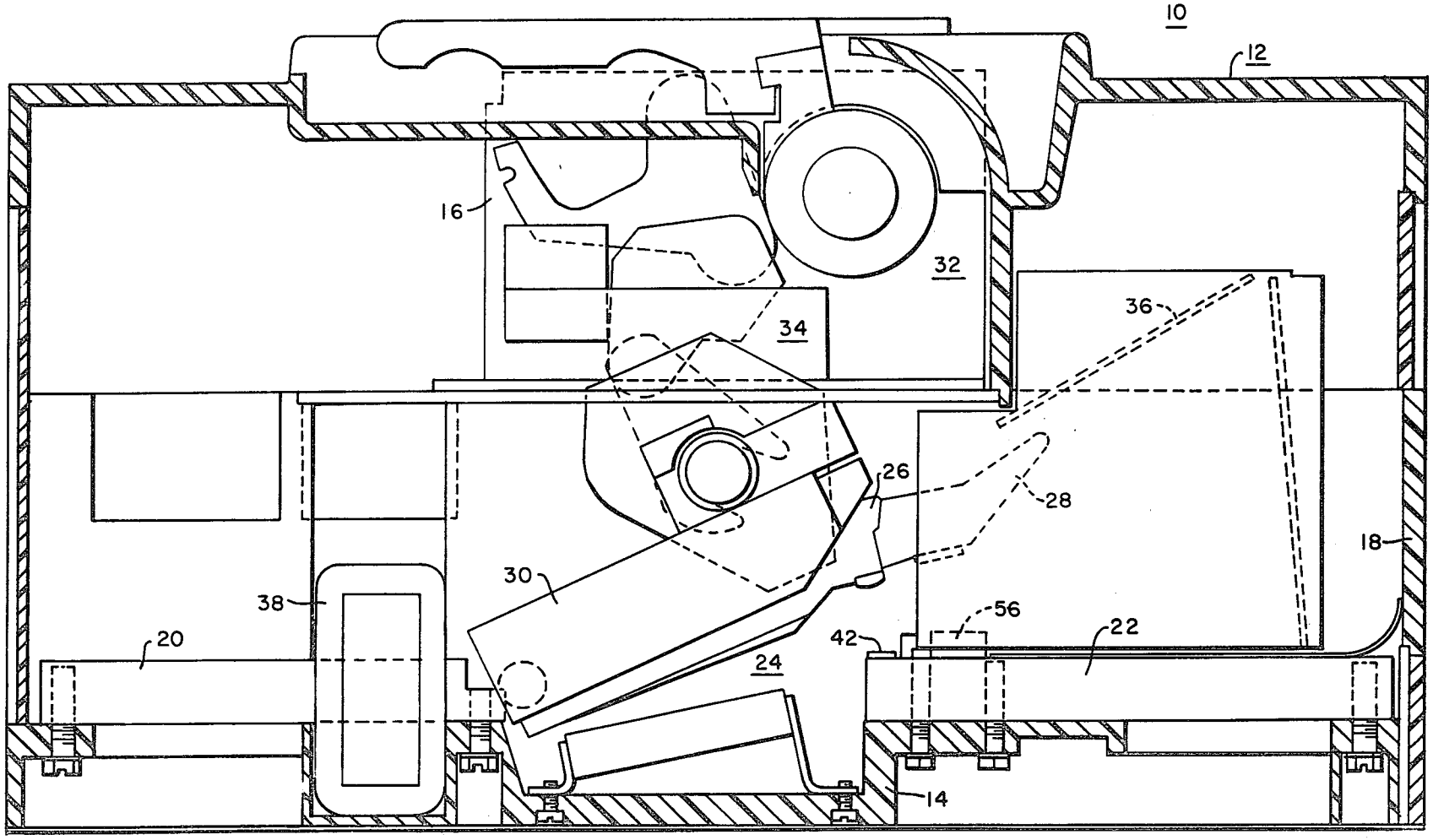
FIG. 1 is an elevational sectional view of a circuit breaker according to the teachings of this invention.

Referring now more particularly to FIG. 1, therein is shown a circuit breaker utilizing the teachings of this invention. Although the description is made with reference to that type of circuit breaker known in the art as a molded case circuit breaker, it is to be understood that the invention is likewise applicable to circuit breakers generally. The circuit breaker 10 includes support 12 which is comprised of a mounting base 14, side walls 16, and a frame structure 18. A pair of stationary contacts 20, 22 are disposed within the support 12. Stationary contact 22 would, for example, be connected to an incoming power line (not shown), while the other stationary contact 20 would be connected to the load (not shown). Electrically connecting the two stationary contacts 20, 22 is a movable contact structure 24. The movable contact structure 24 comprises a movable contact 26, a movable arcing contact 28, a contact carrier 30 and contact holder 64 (See FIG. 13). The movable contact 26 and the arcing contact 28 are pivotally secured to the stationary contact 20, and are capable of being in open and closed positions with respect to the stationary contact 22. Throughout this application, the term "open" as used with respect to the contact positions means that the movable contacts 26, 28 are spaced apart from the stationary contact 22, whereas the term "closed" indicate the position wherein the movable contacts 26, 28 are contacting both stationary contacts 22 and 20. The movable contacts 26, 28 are mounted to, and carried by the contact carrier 30 and contact holder 64.

Also included within the circuit breaker 10 is an operating mechanism 32, a toggle means 34, and an arc chute 36 which extinguishes any arc which may be present when the movable contacts 26, 28 change from the closed to open position. A current transformer 38 is utilized to monitor the amount of current flowing through the stationary contact 20.

Figure 12:
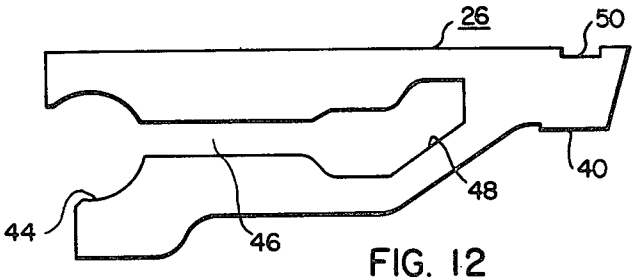
FIG. 12 is a detailed view of the movable contact.

Referring now to FIG. 12, there is shown a detailed view of the movable contact 26. The movable contact 26 is of a good electrically conducting material such as copper, and has a contact surface 40 which mates with a similar contact surface 42 (see FIG. 1) of stationary contact 22 whenever the movable contact 26 is in the closed position. The movable contact 26 has a circular segment 44 cut out at the end opposite to the contact surface 40, and also has a slotted portion 46 extending along the movable contact 26 from the removed circular segment 44. At the end of the slot 46 is an opening 48. The movable contact 26 also has a depression 50 at the end thereof opposite the contact surface 40.

Figure 10:
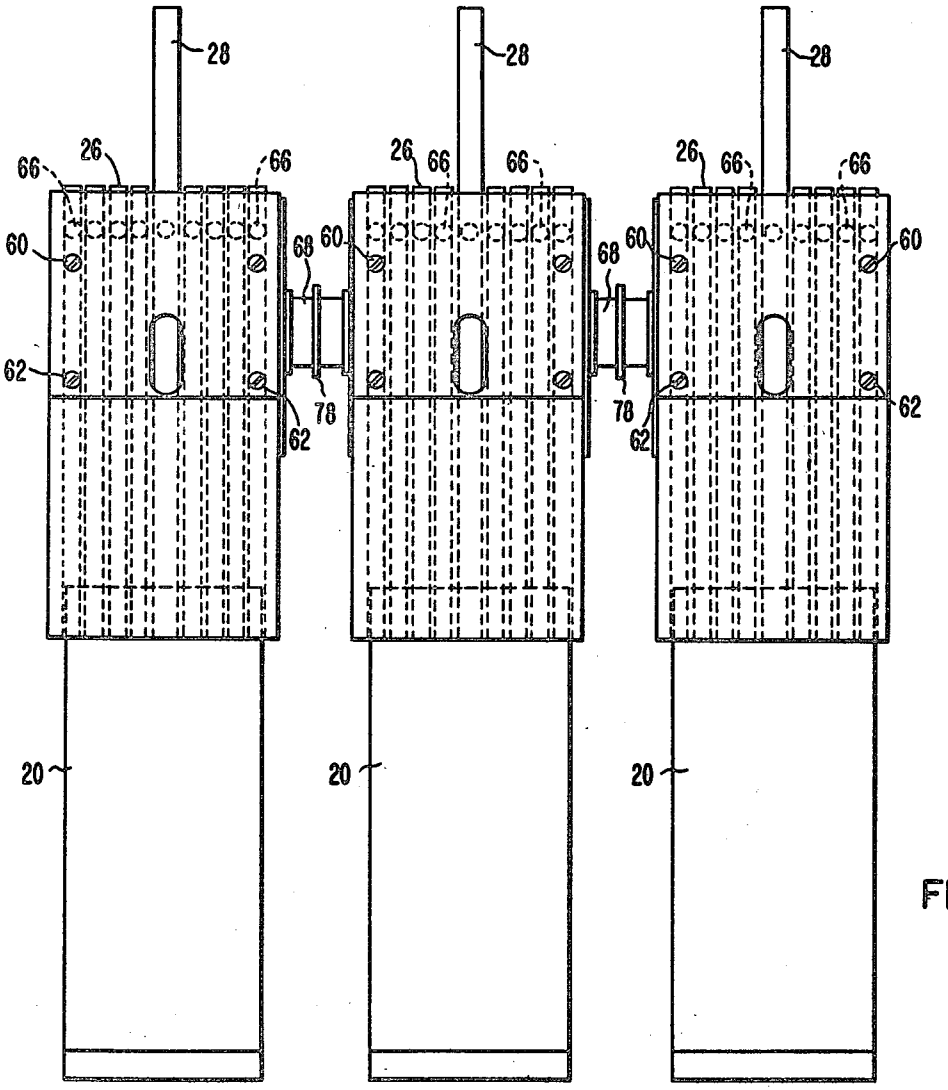
FIG. 10 a plan view of a current carrying contact system.
Figure 11:
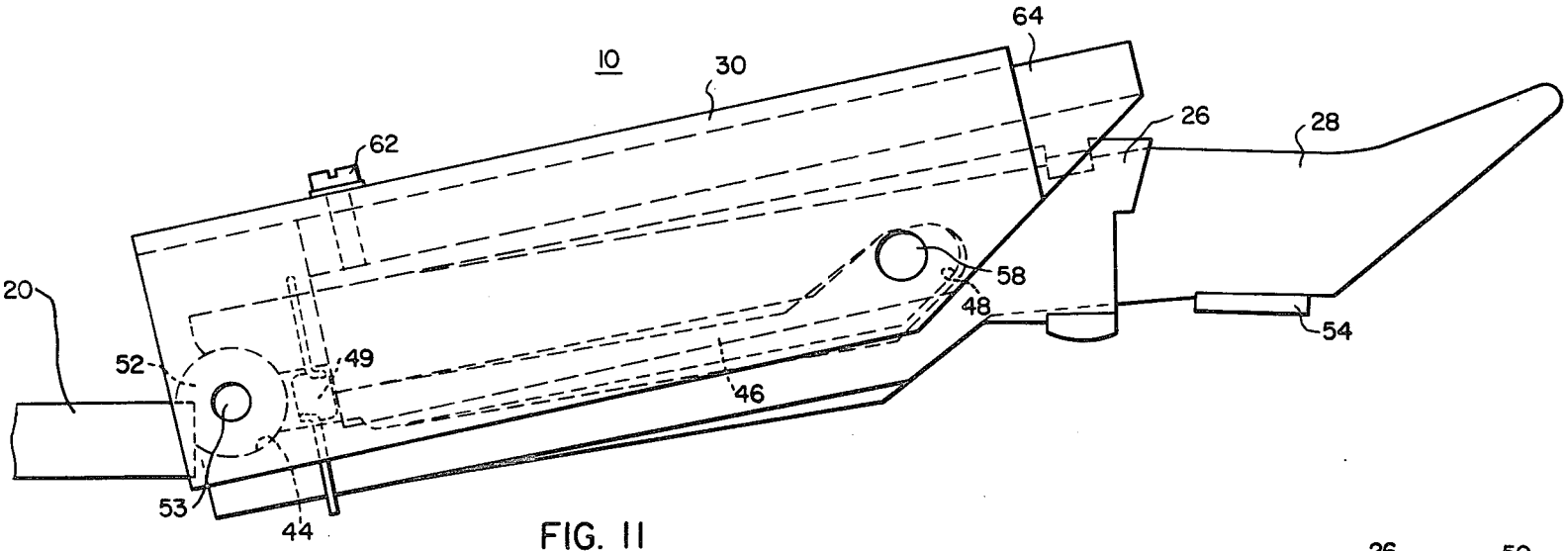
FIG. 11 is a side, sectional view of the current conducting system.

The circular segment 44 of the movable contact 26 is sized so as to engage a circular segment 52 which is part of the stationary contact 20 (see FIG. 11). The circular segment 44 and the slot 46 are utilized to clamp about the circular segment 52 to thereby allow pivoting of the movable contact 26 while maintaining electrical contact with the stationary contact 20. As shown in FIG. 11, the arcing contact 28 is designed similarly to the movable contact 26, except that the arcing contact 28 extends outwardly beyond the movable contact 26 and provides an arcing mating surface 54 which contacts a similarly disposed surface 56 on the stationary contact 22. The arcing contact 28 and the movable contact 26 are mounted to, and carried by a contact carrier 30. A pin 58 extends through the openings 48 in the movable contact 26 and the arcing contact 28, and this pin 58 extends outwardly to, and is secured to, the contact carrier 30. The contact carrier 30 is secured by screws 60, 62 (See FIG. 10) to a contact and spring holder 64. The contact and spring holder 64 is typically of a molded plastic. By so constructing the connections of the movable contact 26 to the contact carrier 30, the movable contacts 26 are permitted a small degree of freedom with respect to each other. To maintain contact pressure between the movable contact surface 40 and the stationary contact surface 42 when the movable contact 26 is in the closed position, a spring 66 is disposed within the recess 50 of the movable contact 26 and is secured to the spring holder 64 (see FIG. 10). The spring 66 resists the forces which may be tending to separate the movable contacts 26 from the stationary contact 22.

Figure 13:
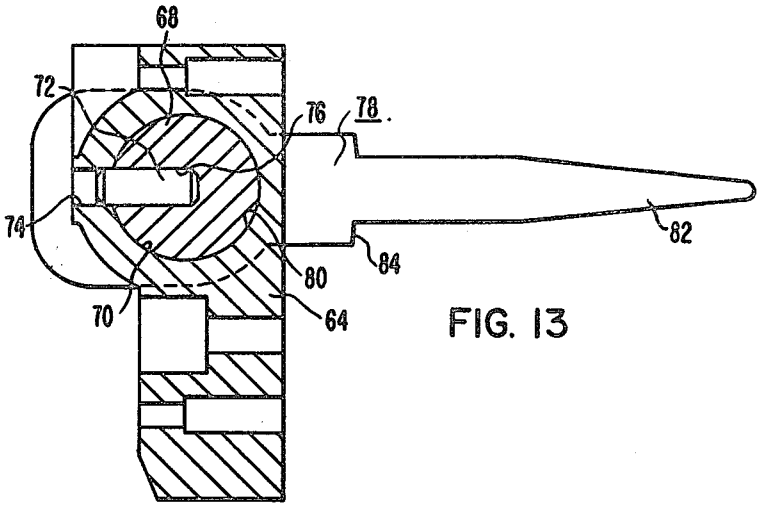
FIG. 13 is a side view of the cross arm structure.

Also shown in FIG. 10 is a cross arm 68 which extends between the individual contact holders 64. The cross arm 68 assures that each of the three poles illustrated will move simultaneously upon movement of the operating mechanism 32 to drive the contacts 26, 28 into closed or open position. As shown in FIG. 13, the cross arm 68 extends within an opening 70 in the contact holder 64. A pin 72 extends through an opening 74 in the contact holder 64 and an opening 76 in the cross arm 68 to prevent the cross arm 68 from sliding out of the contact holder 64. Also attached to the cross arm 68 are pusher rods 78. The pusher rods 78 have an opening 80 therein, and the cross arm 68 extends through the pusher rod opening 80. The pusher rod 78 has a tapered end and more particularly the tapered portion 82 extends into openings 86 within the breaker mounting base 14, (see FIG. 2) and disposed around the pusher rods 78 are springs 88. These springs 88 function to exert a force against the shoulder 84 of the pusher rod 78, thereby biasing the cross 68 and the movable contacts 26 in the open position. To close the movable contacts 26, it is necessary to move the cross arm 68 such that the pusher rods 78 will compress the spring 88. This movement is accomplished through the operating mechanism 32 and the toggle means 34.

Figure 2:
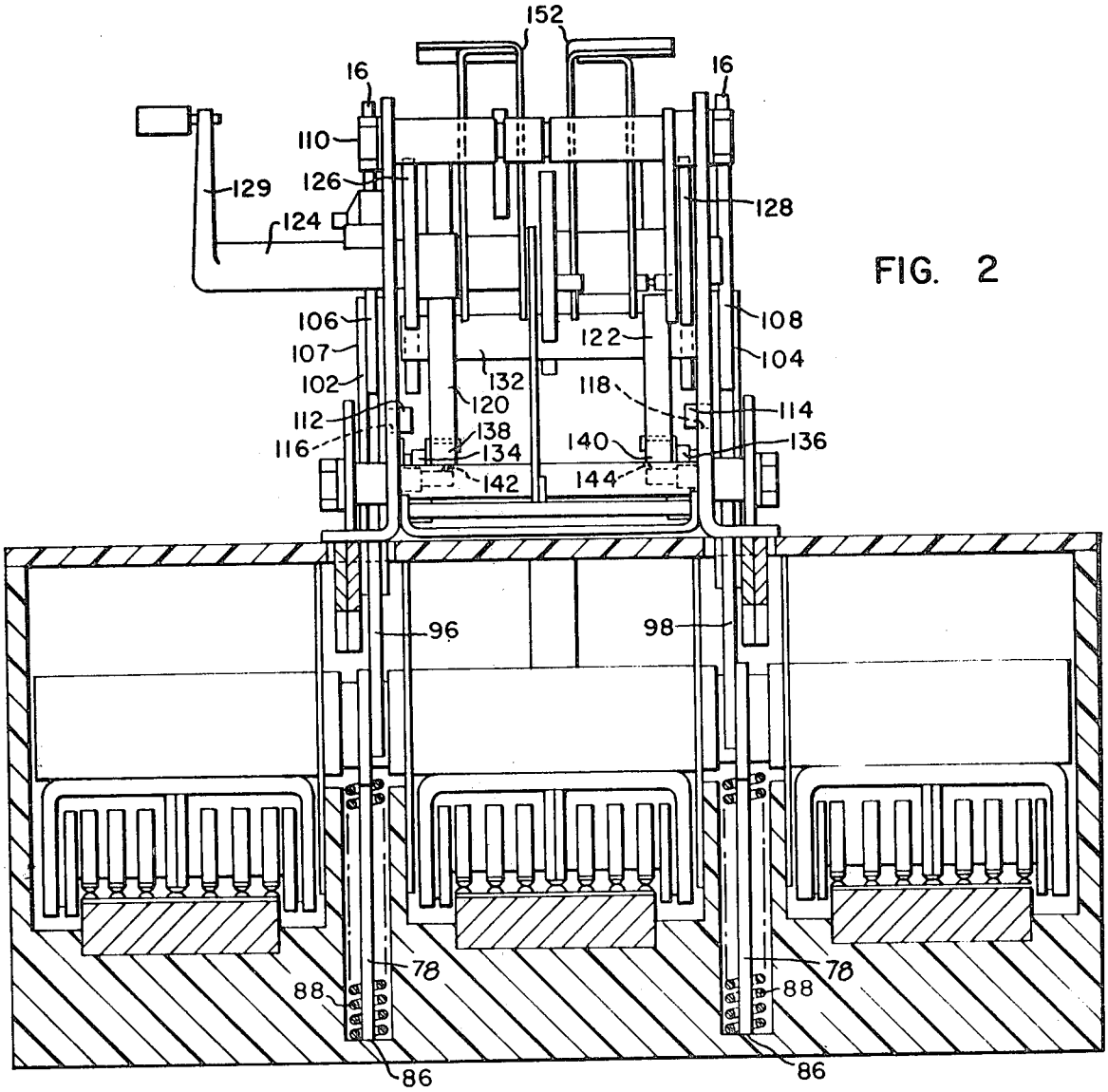
FIG. 2 is an end view taken along line II—II of FIG. 1.
Figure 14:
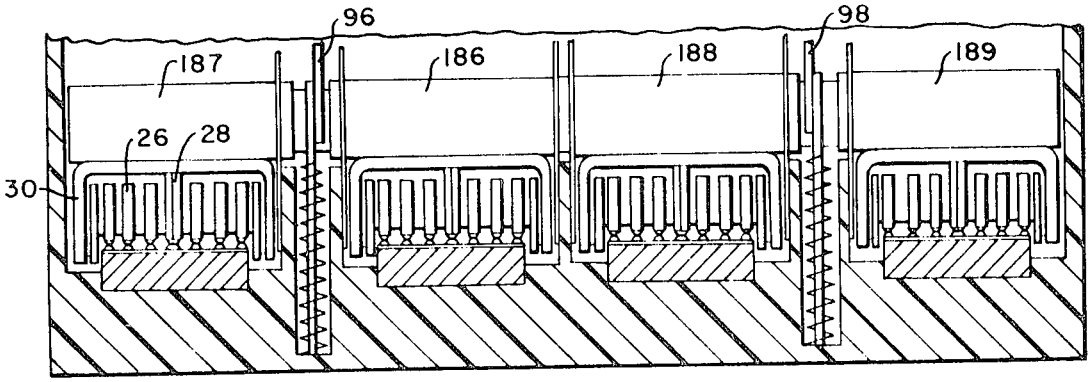
FIG. 14 is a modification of the multi-pole contact structure.
Figure 3:
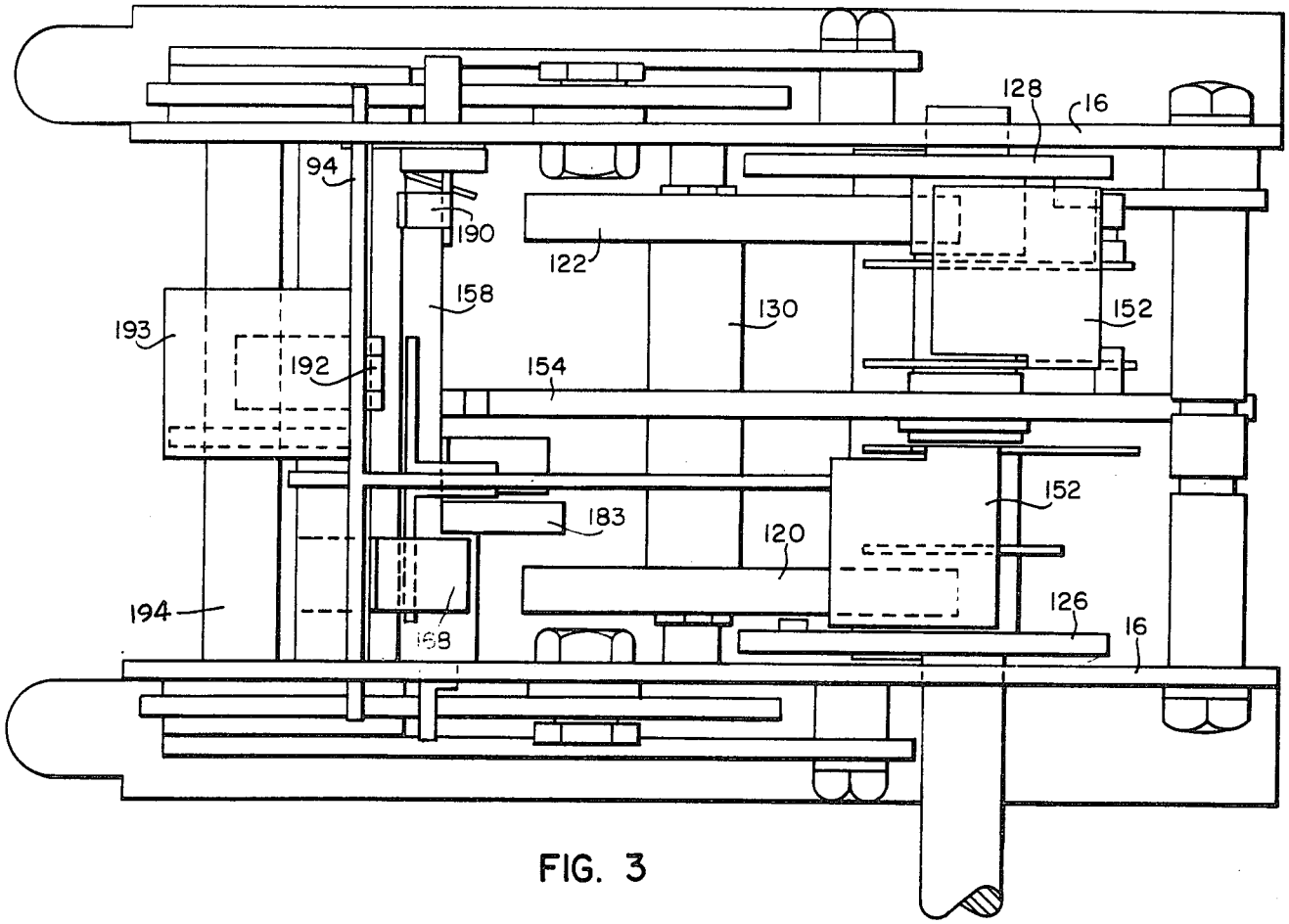
FIG. 3 is a plan view of the mechanism illustrated in FIG. 4.
Figure 4:
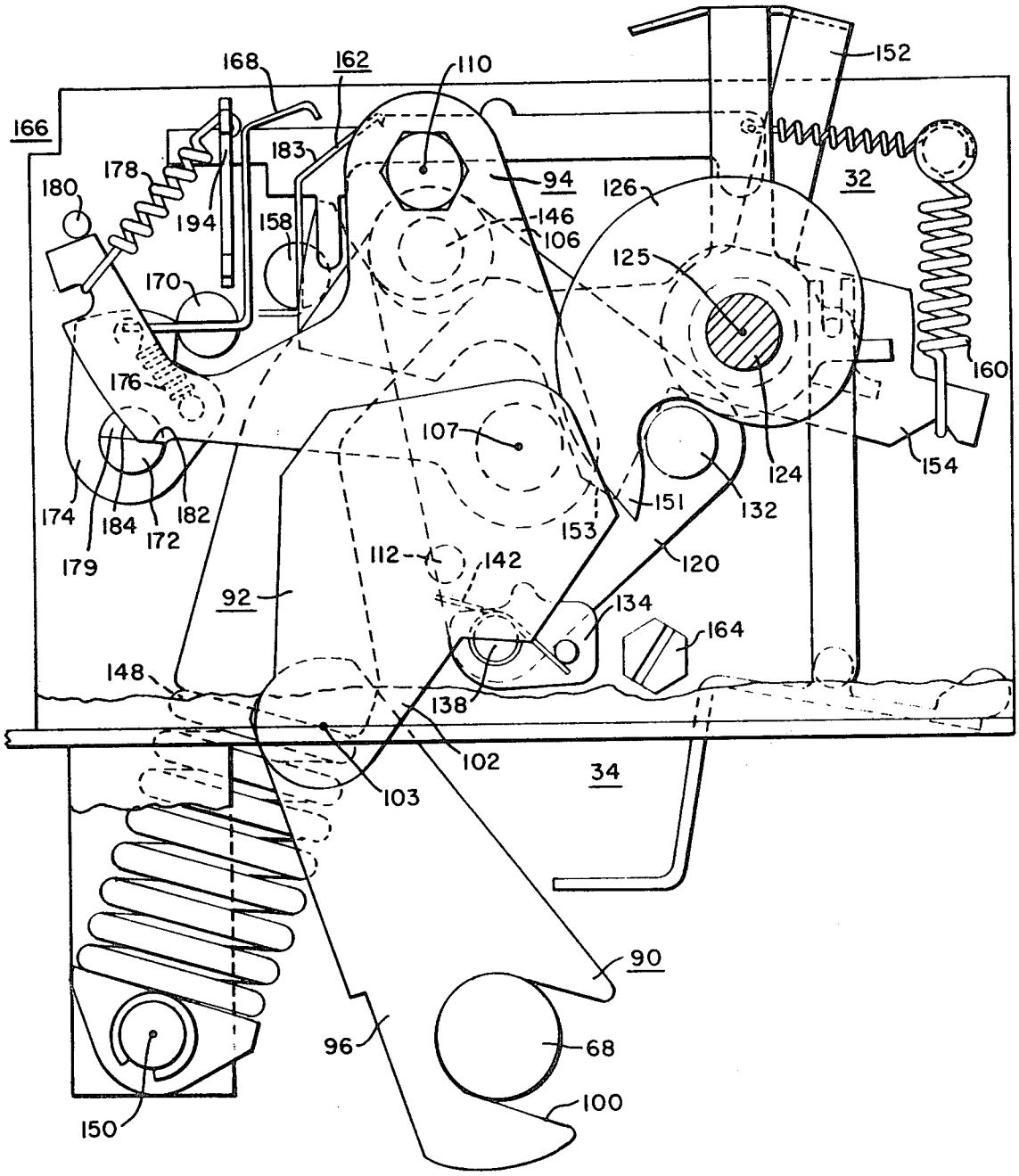
FIG. 4 is a detailed sectional view of the operating mechanism of the circuit breaker in the spring discharged, contact open position.

Referring now to FIGS. 2–4, there is shown the toggle means 34 and the operating mechanism 32. The toggle means 34 comprise a first link 90, a second link 92, and a toggle lever 94. The first link 90 is comprised of a pair of spaced apart first link elements 96, 98, each of which have a slot 100 therein. The first link elements 96, 98 and the slot 100 engage the cross arm 68 intermediate the three contact holders 64, and provide movement of the cross arm 68 upon the link 90 going into toggle position. The location of the link elements 96, 98 intermediate the contact holders 64 reduces any deflection of the crossarm 68 under high short circuit forces. Also, the use of the slot 100 to connect to this crossarm 68 provides for easy removal of the operating mechanism 32 from the crossarm 68. Although described with respect to the three-pole breaker illustrated in FIG. 2, it is to be understood that this description is likewise applicable to the four-pole breaker illustrated in FIG. 14. With this four-pole breaker, the first link elements 96, 98 are disposed between the interior contact holders 186, 188 and the exterior holders 187, 189. Also, if desired, an additional set of links or additional springs (not shown) may be disposed between the interior holders 186, 188. The second link 92 comprises a pair of spaced apart second link elements 102, 104 which are pivotally connected to the first link elements 96, 98, respectively at pivot point 103. The toggle lever 94 is comprised of a pair of spaced apart toggle lever elements 106, 108 which are pivotally connected to the second link elements 102, 104 at pivot point 107, and the toggle lever elements 106, 108 are also pivotally connected to side walls 16 at pivotal connection 110. Fixedly secured to the second link elements 102, 104 are aligned drive pins 112, 114. The drive pins 112, 114 extend through aligned openings 116, 118 in the side walls 16 adjacent to the follower plates 120, 122.

The operating mechanism 32 is comprised of a drive shaft 124 rotatable about its axis 125 having a pair of spaced apart aligned cams 126, 128 secured thereto. The cams 126, 128 are rotatable with the drive shaft 124 and are shaped to provide a constant load on the turning means 129. Turning means such as the handle 129 may be secured to the drive shaft 124 to impart rotation thereto. The operating mechanism 32 also includes the follower plates 120, 122 which are fixedly secured together by the follower plate connector 130 (see FIG. 3). Fixedly secured to the follower plates 120, 122 is a cam roller 132, which also functions in latching the follower plates 120, 122 in the charged positions, as will be hereinafter described. Also secured to each follower plate 120, 122 is a drive pawl 134, 136, respectively, which is positioned adjacent to the drive pins 112, 114. The drive pawls 134, 136 are pivotally secured to the follower plates 120, 122 by pins 138, 140, and are biased by the springs 142, 144.

The follower plates 122, 120 are also connected by a connecting bar 146 which extends between the two follower plates 120, 122, and pivotally connected to the connecting bar 146 are spring means 148. Spring means 148 is also pivotally connected to the support 12 by connecting rod 150. If desired, indicating apparatus 152 (see FIG. 2) may be incorporated within the breaker 10 to display the positions of the contacts 26, 28 and the spring means 148.

Figure 5:
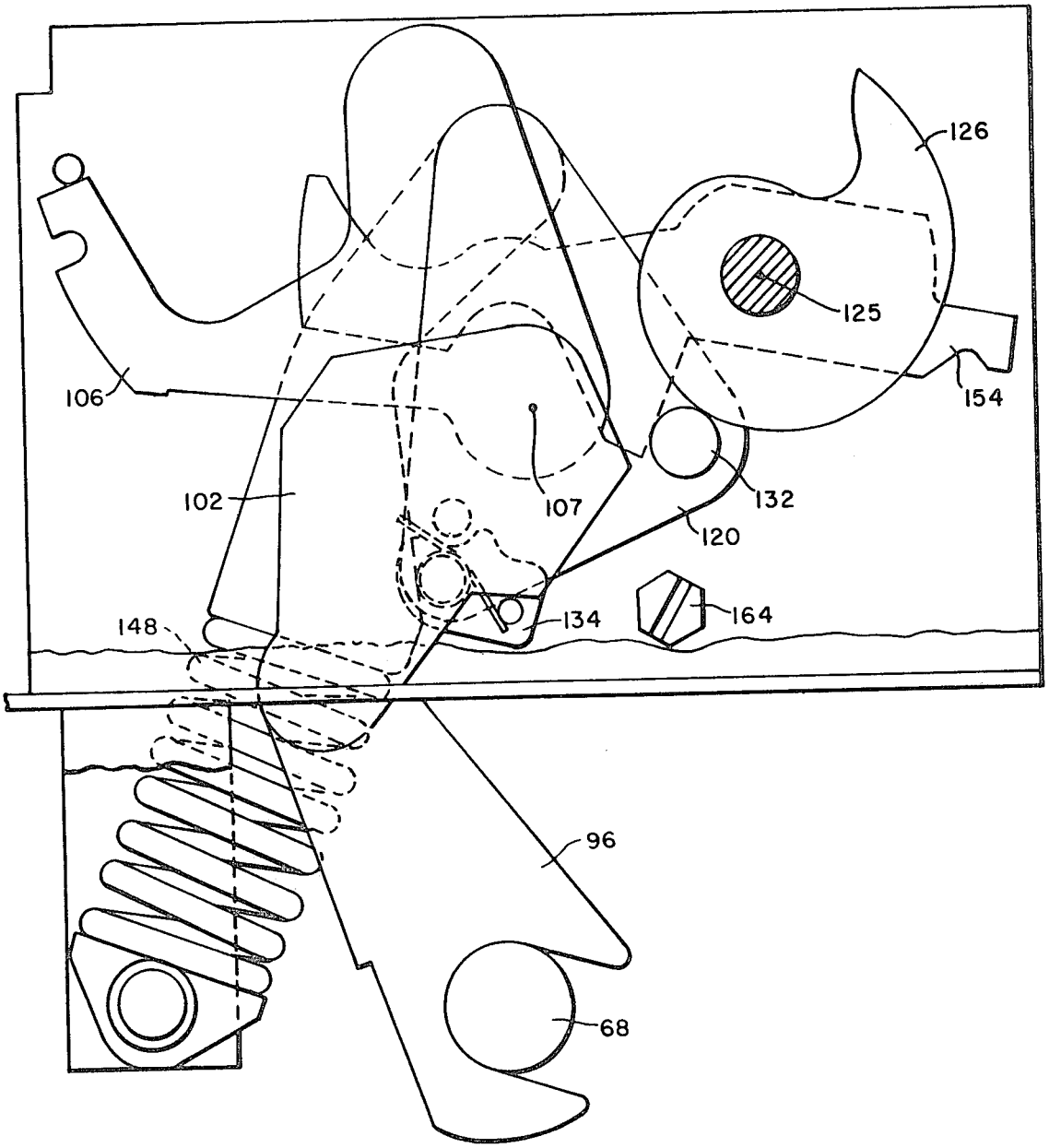
FIG. 5 is a modification of a view in FIG. 4 with the spring partially charged and the contact in the open position.

The operation of the circuit breaker can be best understood with reference to FIGS. 3–9. FIGS. 4–9 illustrate, in sequence, the movement of the various components as the circuit breaker 10 changes position from spring discharged, contact open, to spring charged, contact closed positions. In FIG. 4, the spring 148 is discharged, and the movable contact 26 is in the open position. Although the contacts 20, 22, and 26, 28 are not illustrated in FIGS. 4–9, the cross arm 68 to which they are connected is illustrated, and it is to be understood that the position of the cross arm 68 indicates the position of the movable contact 26 with respect to the stationary contact 22. To begin, the drive shaft 124 is rotated in the clockwise direction by the turning means 129. As the drive shaft 124 rotates, the cam roller 132 which is engaged therewith, is pushed outwardly a distance equivalent to the increased diameter portion of the cam. FIG. 5 illustrates the position of the elements once the cam 126 has rotated about its axis 125 approximately 180° from its initial starting position. As can be seen, the cam roller 132 has moved outwardly with respect to its initial position. This movement of the cam roller 132 has caused a rotation of the follower plate 120 about its axis 107, and this rotation has stretched the spring 148 to partially charge it. Also to be noted is that the drive pawl 134 has likewise rotated along with the follower plate 120. (The preceding, and all subsequent descriptions of the movements of the various components will be made with respect to only those elements viewed in elevation. Most of the components incorporated within the circuit breaker preferably have corresponding, identical elements on the opposite side of the breaker. It is to be understood that although these descriptions will not mention these corresponding components, they behave in a manner similar to that herein described, unless otherwise indicated.)

Figure 6:
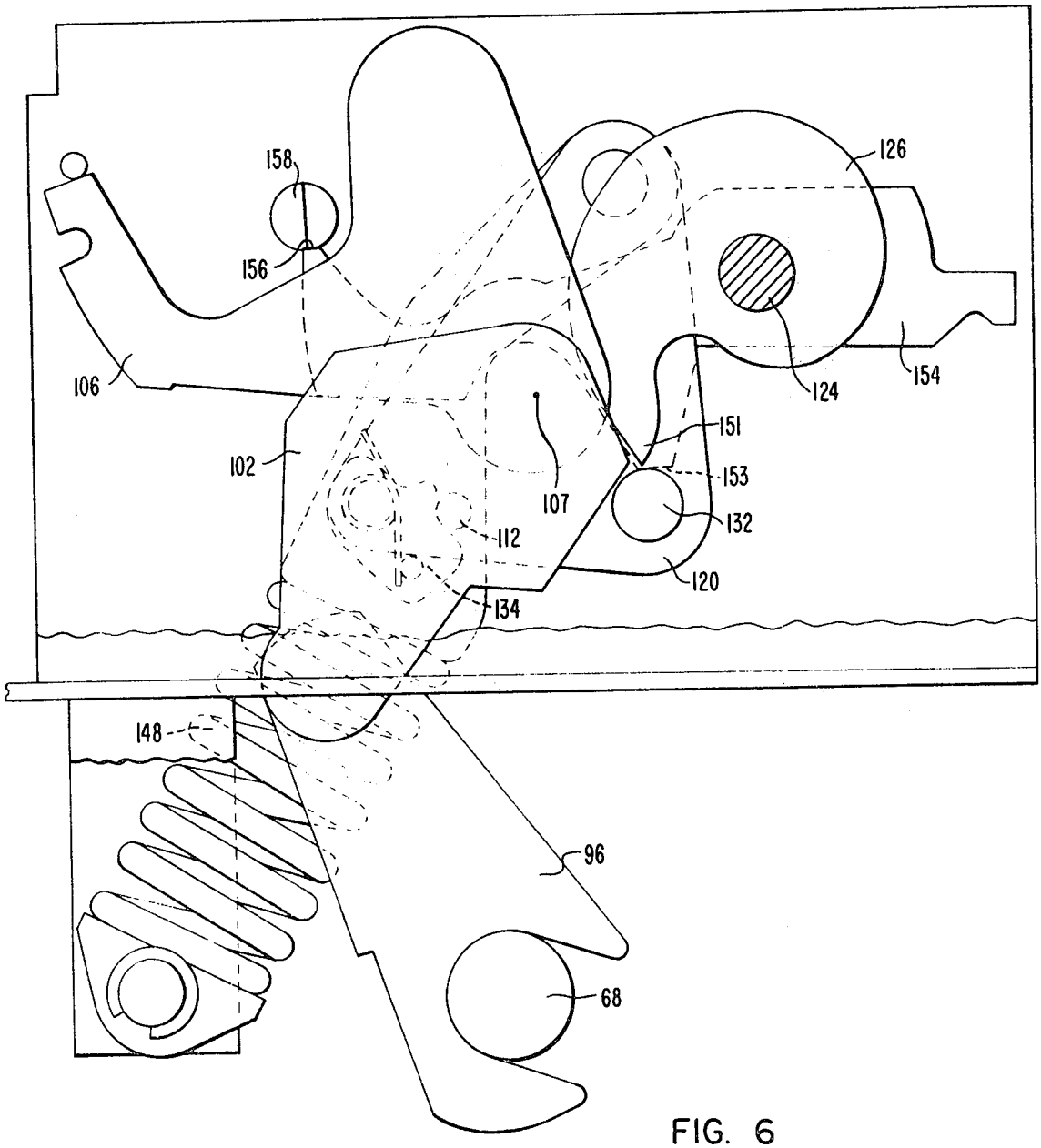
FIG. 6 is a modification of the views illustrated in FIGS. 4 and 5 with the spring charged and the contact open.
Figure 7:
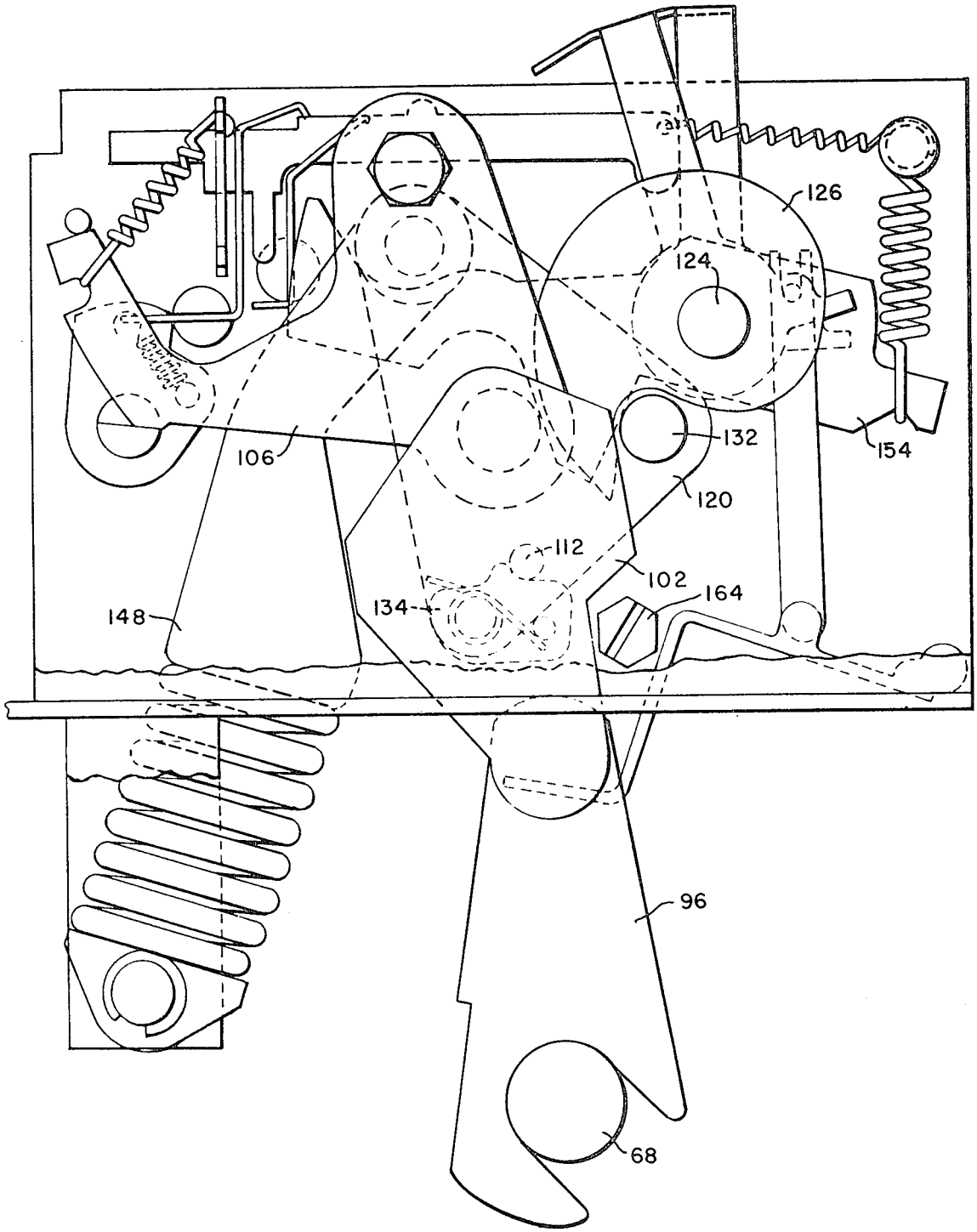
FIG. 7 is a modification of the view of FIGS. 4, 5, and 6 in the spring discharged, contact closed position.

FIG. 6 illustrates the position of the components once the cam 126 has further rotated. The cam roller 132 has traveled beyond the end point 151 of the cam 126, and has come into contact with a flat surface 153 of a latch member 154. The follower plate 120 has rotated about its axis 107 to its further extent, and the spring 148 is totally charged. The drive pawl 134 has moved to its position adjacent to the drive pin 112. The latch member 154, at a second flat surface 156 thereof has rotated underneath the curved portion of a D-latch 158. In this position, the spring 148 is charged and would cause counterclockwise rotation of the follower plate 120 if it were not for the latch member 154. The surface 153 of latch member 154 is in the path of movement of the cam roller 132 as the cam roller 132 would move during counterclockwise rotation of the follower plate 120. Therefore, so long as the surface 153 of the latch member 154 remains in this path, the cam roller 132 and the follower plate 120 fixedly secured thereto cannot move counterclockwise. The latch member 154 is held in its position in the path of the cam roller 132 by the action of the second surface 156 against the D-latch 158. The latch member 154 is pivotally mounted on, but independently movable from, the drive shaft 124 (see FIGS. 2 and 3), and is biased by the spring 160. The force of the cam roller 132 is exerted against the surface 153 and, if not for the D-latch 158, would cause the latch member 154 to rotate about the drive shaft 124 in the clockwise direction to release the roller 132 and discharge the spring 148. Therefore, the D-latch 158 prevents the surface 156 from moving in a clockwise direction which would thereby move the first surface 153 out of the path of movement of the cam roller 132 upon rotation of the follower plate 120. To release the latch member 154, the releasable release means 162 are depressed, which causes a clockwise rotation of D-latch 158. The clockwise movement of the D-latch 158 disengages from the second surface 156 of the latch member 154, and the latch member 154 is permitted to rotate clockwise, resulting in the movement of the first surface 153 away from the path of the cam roller 132. The results of such release is illustrated in FIG. 7.

Once the latch member 154 is released, the spring 148 discharges, causing rotation of the follower plate 120 about its pivot axis 107. The rotation of the follower plate 120 moves the cam roller 132 into its position at the smallest diameter portion of the cam 126. At the same time, the rotation of the follower plate 120 causes the drive pawl 134 to push against the drive pin 112. This pushing against the drive pin 112 causes the drive pin 112, and the second link element 102 to which it is connected to move to the right as illustrated in the drawing. This movement causes the second link element 102 and the first link element 96 to move into toggle position with toggle lever element 106. This movement into the toggle position causes movement of the cross arm 68, which compresses the shoulder 84 of the pusher rod 78 against the springs 88 (see FIG. 2), and moves the movable contacts 26 into the closed position in electrical contact with the stationary contact 22. The movable contact 26 will remain in the closed position because of the toggle position of the toggle means 34. Once the toggle means 34 are in toggle position, they will remain there until the toggle lever 94 is released. As can be noticed from the illustration, the drive pawl 134 is now in its original position but adjacent to the drive pin 112. The first link 90 and the second link 92 are limited in their movement as they move into toggle position by the limiting bolt 164. This bolt 164 prevents the two links 90, 92 from knuckling over backwards and moving out of toggle position. (Throughout this application, the term "toggle position" refers to not only that position when the first and second links are in precise alignment, but also includes the position when they are slightly over-toggled.) The status of the breaker at this position is that the spring 148 is discharged, and the contacts 26 are closed.

Figure 8:
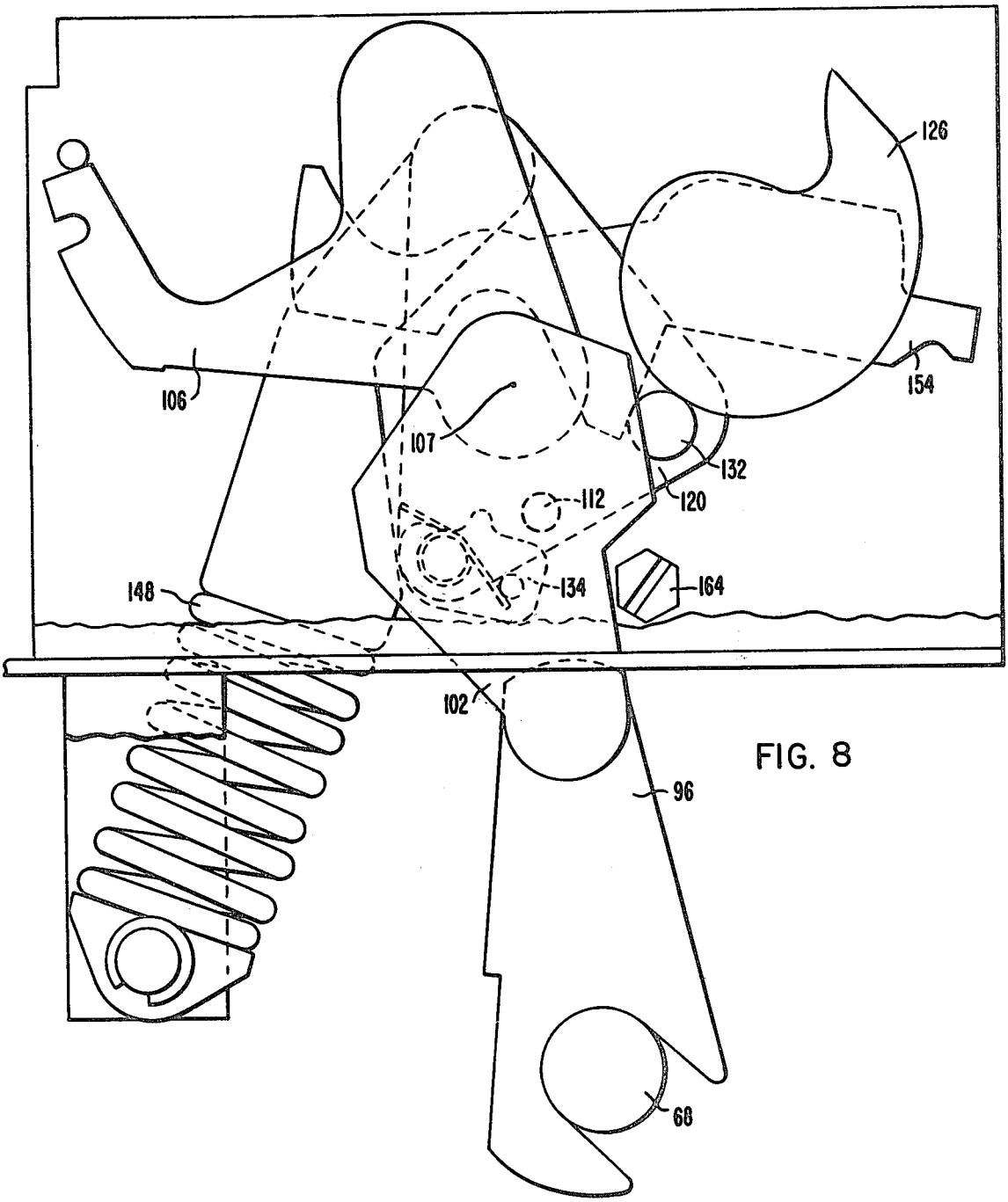
FIG. 8 is a modification of the view of FIGS. 4, 5, 6, and 7 with the spring partially charged and the contact closed.
Figure 15:
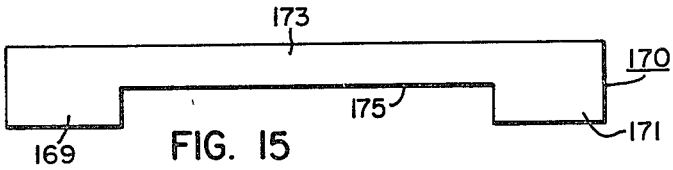
FIG. 15 is an elevational view of a standard D-latch.
Figure 16:
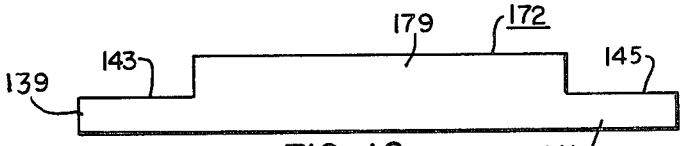
FIG. 16 is an elevational view of a modified D-latch utilized in the circuit breaker of this invention.
Figure 9:
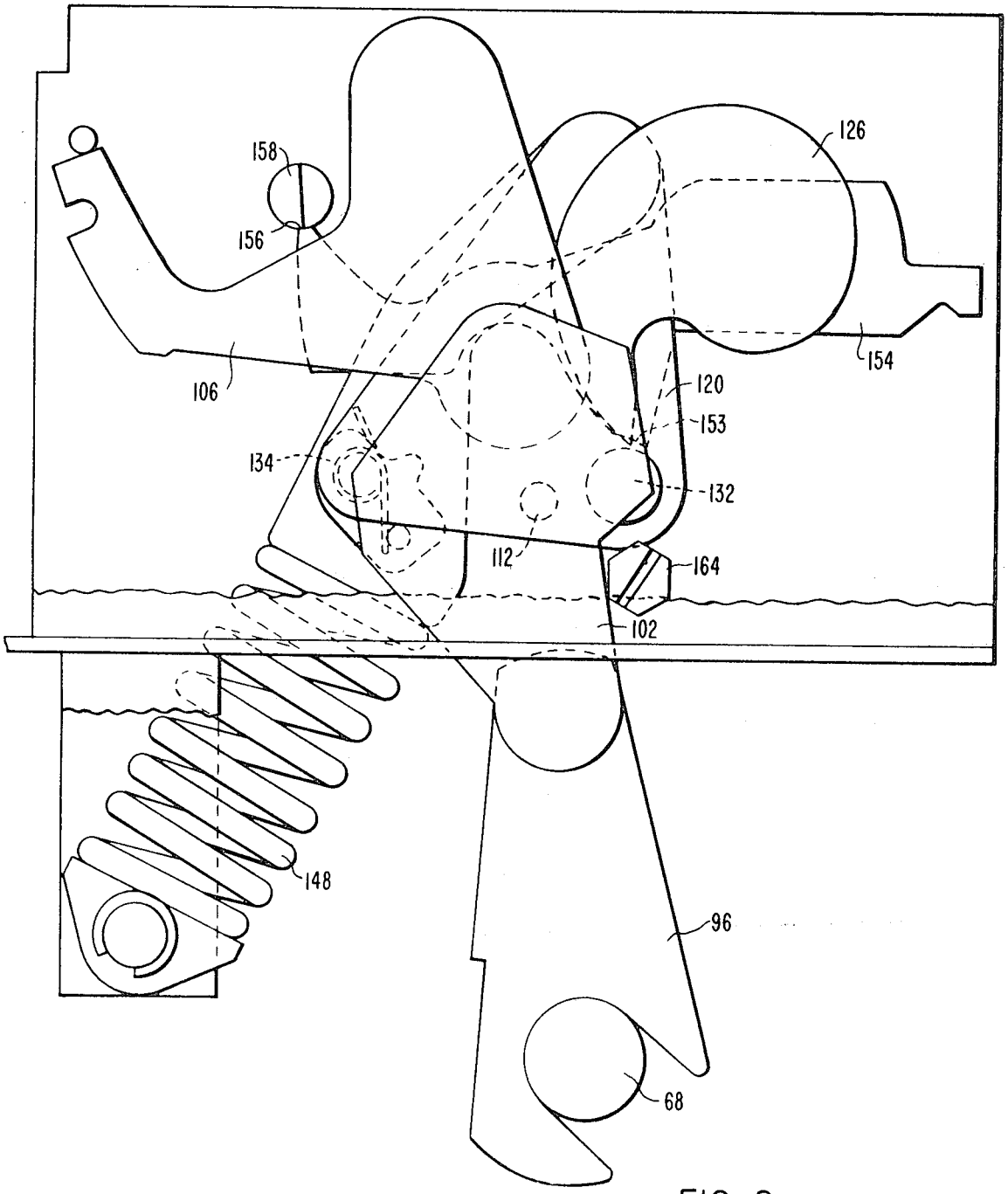
FIG. 9 is a modification of the view of FIGS. 4, 5, 6, 7, and 8 with the spring charged and the contact closed.

FIG. 8 then illustrates that the spring 148 can be charged while the contacts 26 are closed, to thereby store energy to provide an open-close-open series. FIG. 8 is similar to FIG. 5, in that the cam has been rotated about 180°, and the follower plate 120 has rotated about its pivot point 107 to partially charge the spring 148. Again, the drive pawl 134 has rotated with the follower plate. FIG. 9 illustrates the situation wherein the spring 148 is totally charged and the contacts 26 are closed. The drive pawl 134 is in the same position it occupied in FIG. 6, except that the drive pin 112 is no longer in contact with it. The latch member 154 and more particularly the surface 153, is in the path of the cam roller 132 to thereby prevent rotation of the follower plate 120. The second surface 156 is held in its location by the D-latch 158 as previously described. In this position, it can be illustrated that the mechanism is capable of an open-close-open series. Upon release of the toggle latch release means 166, the toggle lever 94 will no longer be kept in toggle position with links 90 and 92, but will instead move slightly in the counterclockwise direction. Upon counterclockwise movement of the toggle lever 94, the second link 92 will move in the clockwise direction, pivoting about the connection with the toggle lever 94, and the first link 90 will move in the counterclockwise direction with the second link 92. Upon so moving out of toggle, the force on the cross arm 68 which pushed the pusher rod 78 against the spring 88 will be released, and the release of the spring 88 will force the cross arm 68 and the movable contacts 26 into the open position. This then is the position of the components as illustrated in FIG. 6. To then immediately close the contacts 26, the latch member 154 is released, which, as previously described, causes rotation of the follower plate 120 such that the drive pawl 134 contacts the second link element 102 to which it is fixedly secured to move back into toggle position. This then results in the position of the components as illustrated in FIG. 7. The breaker 10 then can immediately be opened again by releasing the toggle latch release means 166, which will position the components to the position illustrated in FIG. 4. Thus it can be seen that the mechanism permits a rapid open-close-open series.

In the preferred embodiment illustrated, the positions of the various components have been determined to provide for the most economical and compacted operation. The input shaft 124 to the operating mechanism 32 is through a rotation of approximately 360°. However, the output torque occurs over a smaller angle, thereby resulting in a greater mechanical advantage. As can be seen from the sequential illustration, the output torque occurs over an angle of less than 90°. This provides a mechanical advantage of greater than 4 to 1. For compactness and maximum efficiency, the pivotal connection of the second link 92 to the toggle lever 94 is coincident with, but on separate shafts from, the rotational axis of the follower plates 120, 122. Another mechanical advantage is present in the toggle latch release means 166 when it is desired to release the toggle means 34 from toggle position.

The toggle latch release means 166 are illustrated in FIGS. 3, 4, 15, and 16. The toggle latch release means 166 are comprised of the latch member release lever 168, the two D-latches 170 and 172, the catch 174, biasing springs 176 and 178 and the stop pin 180. The D-latch 170 is a standard D-latch which has two cylindrical end sections 169, 171 which are rotatably secured to the side walls 16, and an intermediate portion 173. The intermediate portion 173 is semi-circular in cross section, and incorporates a flat surface 175 across a portion thereof. The D-latch 172 is a modified D-latch which may be comprised of a rod having end portions 139, 141 which extend through the side wall 16 to adjacent to, and contacting, the toggle lever 94. Similarly to the standard D-latch 170, the modified D-latch 172 and more particularly the end portions 139, 141 are semi-circular in design, and have a flat surface 143, 145 thereon. It is upon these flat surfaces 143, 145 that the two toggle lever elements 106, 108 contact. To release the toggle means 34, the latch member release lever 168 is depressed. The depressing of this lever 168 causes a clockwise rotation of the D-latch 170. The catch 174 which had been resting on the rounded portion 177 of D-latch 170 but was biased for clockwise rotation by the spring 176 is then permitted to move clockwise adjacent the flat portion 175 of D-latch 170. The clockwise movement of the catch 174 causes a corresponding clockwise movement of the modified D-latch 172 to whose shaft 179 the catch 174 is fixedly secured. The clockwise movement of the D-latch 172 causes the toggle lever 94, and more particularly the flat surface 182 which the D-latch flat surface 143 originally contacted, to move, such that the surface 184 is now resting upon the D-latch flat surface 143. This then allows the toggle lever 94 to move in a counterclockwise direction, thereby releasing the toggle of the toggle means 34. After the toggle means 34 have been released, and the movable contact 26 positioned in the open position, the biasing spring 178 returns the toggle lever 94 to its position wherein the surface 182 is resting upon the D-latch flat surface 143. To prevent the toggle lever 94 from moving too far in the clockwise direction, the stop pin 180 is utilized to stop the toggle lever 94 at its correct location. The mechanical advantage in this release system occurs because of the very slight clockwise rotation of the D-latch 172 which releases the toggle lever 94 as compared to the larger rotation of the release latch 168. As an example of the relative sizes of the positions of the latch release means 166, the distance the modified D-latch 172 is required to rotate before moving from surface 182 to surface 184 of toggle lever 94 may be 0.030 to 0.060 inches whereas the distance between the flat surfaces 143, 175 of D-latches 172, 170 respectively may be on the order of 1 inch. This gives a reduction of force of 33 to 1 or 16 to 1, whichever is desirable. Thus, the load on the standard D-latch 170 is very light, which allows it to turn very rapidly on a trip operation. The modified D-latch 172 also moves rapidly due to its very low inertia, mounted to the side walls 16 with needle bearings to minimize the friction forces.

As can be seen in FIG. 3, the D-latches 170 and 158 are attached to two levers each. Levers 183 and 190 are secured to D-latch 158, and levers 168 and 192 are secured to D-latch 170. The extra levers 190 and 192, are present to permit electromechanical or remote tripping of the breaker and spring discharge. An electromechanical flux transfer shunt trip 193 (see FIG. 3) may be secured to the frame 194 and connected to the current transformer 38 so that, upon the occurrence of an overcurrent condition, the shunt trip 193 will move lever 192 in the clockwise direction to provide release of the toggle lever 94 and opening of the contacts 26. An electrical solenoid device may be positioned on the frame 194 adjacent to lever 190 so that the remote pushing of a switch (not shown) will cause rotation of lever 190 causing rotation of D-latch 158 and discharging of the spring 148 to thereby close the breaker.

Accordingly, the device of the present invention achieves certain new and novel advantages resulting in a compact and more efficient circuit breaker. The breaker utilizes a high speed latching system which provides for rapid tripping of the breaker upon the occurrence of a fault condition, or upon manual operation if desired.

What is claimed is:

1. A circuit breaker comprising:

a pair of contacts including stationary and movable contacts operable between open and closed positions and being biased in the open position;

means for effecting movement of said contacts between said open and closed positions including toggle means comprising first and second links and toggle lever; and releasable toggle latch means for holding said toggle means in toggle position comprising:

a rod having a flat surface thereon adjacent to, and contacting, said toggle lever and rotatable between first and second position, said rod flat surface, when in said position, preventing movement of said toggle lever, said rod flat surface, when in said second position, permitting movement of said toggle lever such that said toggle means are capable of being released from toggle position;

a latch catch fixedly secured to and rotatably with, said rod, movement of said latch catch causing movement of said rod, said latch catch being biased in said rod second position; and releasable means for holding said latch catch in said rod first position comprising a rotatable D-latch capable of being in a first position wherein said D-latch holds said latch catch in said rod first position and capable of being in a second position wherein said latch catch is permitted movement to said rod second position, said D-latch being biased in said D-latch first position and a latch release lever secured to said D-latch for rotating said D-latch between said D-latch first and second positions.

2. The circuit breaker according to claim 1 wherein said D-latch includes a flat surface and a circular segment, said latch catch, when said D-latch is in said D-latch first position, contacting said circular segment, and when said D-latch is in said D-latch second position, being disposed adjacent said D-latch flat surface.

3. A circuit breaker comprising:

a stationary contact;

a movable contact operable between open and closed positions with respect to said stationary contact, said movable contact being biased in the open position;

a movable contact holder, said movable contact being held by said contact holder;

toggle means engaging said contact holder for moving said movable contact between said open and closed positions, said toggle means comprising first and second links and a toggle lever, said first link operatively engaging said contact holder, said second link being pivotally connected to said first link, said toggle lever being pivotally connected to said second link, said second link having a drive pin fixedly secured thereto;

a rotatable drive shaft having a cam secured thereto, said cam being rotatable with said drive shaft;

means for rotating said drive shaft;

a rotatable follower plate having a cam roller secured thereto, said follower plate having a drive pawl pivotally secured thereto, said cam roller engaging said cam, said drive pawl being disposed adjacent said drive pin;

spring means pivotally connected to said follower plate and capable of being in spring charged and spring discharged positions, said spring means being charged by the rotation of said cam causing said cam roller engaged therewith to move outwardly causing rotation of said follower plate causing charging of said spring means, the changing of position of said spring means from charged to discharged causing rotation of said follower plate such that said drive pawl is capable of engaging said drive pin to move said toggle means into a toggle position, the movement of said toggle means into toggle position causing movement of said contact holder which moves said movable contact into closed position;

releasable drive latch means for holding said follower plate in the spring charged position; and releasable toggle latch means for holding said toggle means in toggle position comprising:

a rod having a flat surface thereon adjacent to, and contacting, said toggle lever and rotatable between first and second positions, said rod flat surface, when in said first position, preventing movement of said toggle lever, said rod flat surface, when in said second position, permitting movement of said toggle lever such that said toggle means are capable of being released from toggle position;

a latch catch fixedly secured to, and rotatable with, said rod, movement of said latch catch causing movement of said rod, said latch catch being biased in said rod second position; and releasable means for holding said latch catch in said rod first position.

4. The circuit breaker according to claim 3 wherein said latch catch holding means comprises a rotatable D-latch capable of being in a first position wherein said D-latch holds said latch catch in said rod first position and capable of being in a second position wherein said latch catch is permitted movement to said rod second position, said D-latch being biased in said D-latch first position, and a latch release lever secured to said D-latch for rotating said D-latch between said D-latch first and second positions.

5. The circuit breaker according to claim 4 wherein said D-latch includes a flat surface and a circular segment, said latch catch, when said D-latch is in said D-latch first position, contacting said circular segment, and when said D-latch is in said D-latch second position, being disposed adjacent said D-latch flat surface.

* * * * *